US008199002B2

(12) United States Patent
Suzuki et al.

(10) Patent No.: US 8,199,002 B2
(45) Date of Patent: Jun. 12, 2012

(54) WIRELESS FIRE ALARM SYSTEM

(75) Inventors: Junichi Suzuki, Ikeda (JP); Takashi Saeki, Hirakata (JP); Koji Sakamoto, Hirakata (JP); Masanori Kurita, Hirakata (JP)

(73) Assignee: Panasonic Corporation, Osaka (JP)

( * ) Notice: Subject to any disclaimer, the term of this patent is extended or adjusted under 35 U.S.C. 154(b) by 518 days.

(21) Appl. No.: 12/523,530

(22) PCT Filed: Jan. 16, 2008

(86) PCT No.: PCT/JP2008/051011

§ 371 (c)(1),
(2), (4) Date: Jul. 16, 2009

(87) PCT Pub. No.: WO2008/088079

PCT Pub. Date: Jul. 24, 2008

(65) Prior Publication Data

US 2010/0079278 A1 Apr. 1, 2010

(30) Foreign Application Priority Data

Jan. 17, 2007 (JP) ..... 2007-008545

(51) Int. Cl.
*G08B 1/08* (2006.01)

(52) U.S. Cl. ..... 340/539.17; 340/577; 340/628; 340/286.05; 340/539.27

(58) Field of Classification Search ..... 340/539.17, 340/577, 628, 522, 524, 525, 286.05, 539.1, 340/539.16, 539.27, 581, 693.6; 455/561, 455/78

See application file for complete search history.

(56) References Cited

U.S. PATENT DOCUMENTS 5,587,705 A * 12/1996 Morris ..... 340/628
7,295,128 B2 * 11/2007 Petite ..... 340/628
7,508,299 B2 * 3/2009 Thomas ..... 340/438
2005/0275528 A1 12/2005 Kates

FOREIGN PATENT DOCUMENTS

| | | | |
|---|---|---|---|
| EP | 1 855 260 | A1 | 11/2007 |
| JP | 61-51595 | U | 4/1986 |
| JP | 2005-108071 | A | 4/2005 |
| JP | 2006-343983 | A | 12/2006 |

OTHER PUBLICATIONS

International Search Report for the Application No. PCT/JP2008/051011 mailed Jul. 2, 2008.
Notification of Reasons for Refusal for the Application No. 2010-156870 mailed Aug. 24, 2010.
Notification of Reasons for Refusal for the Application No. 2009-526828 from Japan Patent Office mailed May 11, 2010.

* cited by examiner

*Primary Examiner* — Toan N Pham
(74) *Attorney, Agent, or Firm* — Cheng Law Group, PLLC

(57) ABSTRACT

A power saving wireless fire alarm system has a master station and a plurality of battery-powered fire detecting terminals linked for wireless communication with each other. Upon detection of a fire occurrence at one of the fire detecting terminals, the fire detecting terminal transmit a fire detection message to a master station which in turn transmit a wake-up message to the other fire detecting terminals and thereafter a fire information message which starts a multiple synchronous communication between the master station and the fire detecting terminals. Each fire detecting terminal has a power controller which selects an intermittent reception mode of activating its own receiver only intermittently until receiving the wake-up message or information indicative of the fire occurrence, and select a constant operation mode thereafter to make the fire detecting terminals be ready for the multiple synchronous communication commenced by the fire information message from the master station.

19 Claims, 9 Drawing Sheets

WIRELESS FIRE ALARM SYSTEM

TECHNICAL FIELD

The present invention is directed to a wireless fire alarm system, and more particularly a radio communication fire alarm system including a master station and a plurality of battery-powered fire detecting terminals.

BACKGROUND ART

Japanese Patent Publication No. 2006-343983 discloses a fire alarm system composed of a master station and a plurality of battery-powered fire detecting terminals each equipped with a fire sensor. The fire detecting terminals are linked to the master station for wireless communication with each other for transmitting a fire occurrence data. In order to achieve a reliable and sophisticated information exchange without causing an interference between the fire detecting terminals, a TDMA (time division multiple access) scheme is utilized for synchronous radio communication among the fire detecting terminals and the master station. While the system is required to keep operating over an extended period of time, such TDMA scheme is rather power-consuming to shorten a battery-life and therefore necessitates frequent replacement of the battery, which is inconvenient for system which is expected to see only a very few chance of fire occurrence during its life time.

DISCLOSURE OF THE INVENTION

In view of the above problem, the present invention has been achieved to provide a wireless fire alarm system which is capable of prolonging a battery life, yet assuring a reliable radio communication for exchanging fire information once seeing a fire occurrence. The fire alarm system in accordance with the present invention includes a master station (10A) and a plurality of battery-powered fire detecting terminals (10B) which are linked for wireless communication with each other. The master station is composed of a first receiver (20A) configured to receive a fire detection message from the fire detecting terminals, a first information generator (30A) configured to generate a fire information message upon receiving the fire detection message from any one of the fire detecting terminals, and a first transmitter (40A) configured to transmit the fire information message to each of the fire detecting terminals. The fire information message is configured to define a time reference with regard to a series of timeslots each assigned to receive a reply message from each of the fire detecting terminals and to start a multiple synchronous communication with each of the fire detecting terminals by way of the timeslots.

Each of the fire detecting terminals is composed of a second battery (14B) energizing the fire detecting terminal, a fire sensor (12B) configured to detect a fire condition, a second information generator (30B) configured to generate the fire detection message upon detection of the fire condition, a second transmitter (40B) configured to transmit the fire detection message, a second receiver (40B) configured to receive the fire detection message and the fire information message, and an alarm device (50B) configured to issue a fire alarm upon receiving the fire detection message or the fire information message. The fire detecting terminal includes a power controller (60B) which is configured to selectively provide an intermittent reception mode of activating the second receiver (20B) in a limited reception period alternating with a rest period, and a constant reception mode of constantly keeping the second receiver ready for receiving the fire information message. The second power controller (60B) is configured to select the intermittent reception mode until receiving the fire detection message, and select the constant reception mode thereafter to receive the fire information message for establishing the multiple synchronous communication by way of the timeslots. With this arrangement, the fire detecting terminals can be activated only intermittently until receiving the information of true fire occurrence, thereby reducing a power consumption of the battery for a prolonged battery life, yet assuring to make the multiple synchronous communication between the master station and the fire detecting terminals successfully after acknowledging the fire occurrence for reliable information exchange.

Preferably, the first information generator (30A) of the master station (10A) is configured to generate a wake-up message after receiving the fire detection message from any one of the fire detecting terminals. The wake-up message is configured to be destined for all the fire detecting terminals. In this instance, the first transmitter (40A) of the master station is configured to transmit the wake-up message repeatedly over a predetermined period before transmitting the fire information message in order to wake-up the fire detecting terminals from the intermittent reception mode. The second power controller (60B) of each fire detecting terminal (10B) is configured to select the constant reception mode upon receiving the wake-up message from the master station (10A) and the fire detection message from anyone of the fire detecting terminals whichever comes earlier, thereby making the second receiver ready for the multiple synchronous communication with the master station commenced by the fire information message. Thus, all the fire detecting terminals can be activated by the wake-up signal from the master station for successfully starting the multiple synchronous communication with the master station, even if the fire detecting message from one of the fire detecting terminals fails to wake-up one or more of the other fire detecting terminals.

In this connection, the second transmitter (40B) of the fire detecting terminal may be configured to continue transmitting the fire detection message until receiving the wake-up message from the master station so that the master station can successfully acknowledge the fire detection message and wake-up all the fire detecting terminals for making the multiple synchronous communication thereafter.

Also in this connection, the alarm device (50B) of each fire detecting terminal (10B) is configured to issue the fire alarm upon receiving the wake-up message or the fire detection message whichever comes earlier. Thus, all the fire detecting terminals can successfully give the fire alarm before starting the multiple synchronous communication for prompt attention to residents.

Further, in order to successfully wake-up all the fire detecting terminals prior to the multiple synchronous communication, the first transmitter (40A) of the master station may be configured to transmit the fire information message to start the multiple synchronous communication with the fire detecting terminals with a delay of a predetermined period after receiving the fire detection message first from any one of the fire detecting terminals.

Additionally, it is preferred that each fire detecting terminal (10B) includes a demand generator (80B) which generates a stop demand to be transmitted to the master station by way of the multiple synchronous communication. For this purpose, the information generator (30A) of the master station (10A) is configured to generate a stop instruction and include the stop instruction in the fire information message upon receiving the stop demand from the fire detecting terminal. Upon receiving the fire information message including the stop instruction, the fire detecting terminal is configured to stop issuing the fire alarm from the alarm device for a predetermined stop period. However, the fire detecting terminal resumes issuing the fire alarm when receiving information indicative of the fire occurrence during the stop period.

Also, the fire detecting terminals (10B) may be configured to generate and transmit a restoration request in the form of the reply message by way of the multiple synchronous communication when the fire condition is not detected at its own fire sensors (12B). In this instance, the information generator (30A) of the master station (10A) is configured to generate a restoration instruction and include the restoration instruction in the fire information message when the master station receive the restoration request from all of the fire detecting terminals (10B). When the fire information message including the restoration instruction is received at the fire detecting terminal, the second power controller (60B) of the fire detecting terminal (10B) is responsive to switch into the intermittent reception mode. Thus, the system can be reset back to a power saving mode after the fire is extinguished.

In the present invention, the master station can be also powered by an incorporated battery (12A), and include a first power controller (60A) configured to selectively provide an intermittent reception mode of activating the first receiver (20A) in a limited reception mode alternating with a rest period, and a constant reception mode of constantly keeping the first receiver (20A) ready for receiving the fire information message. Like the second power controller of the fire detecting terminal, the first power controller (60A) is configured to select the intermittent reception mode until receiving the fire detection message from anyone of the fire detecting terminals, and thereafter select a waking-up mode of transmitting the wake-up message repeatedly for a limited number of times and the subsequently select the constant reception mode of transmitting the fire information message for starting the multiple synchronous communication with the fire detection terminals. Thus, the battery-powered master station can be also power-saved for prolonged operation life of the system.

The master station may include an alarm device configured to issue a fire alarm upon receiving the fire detection message for giving the fire alarm also in a site where the master station is installed. Further, the master station can be equipped with a fire sensor (12A) and the first information generator (30A) configured to generate the fire detection message to be transmitted to each of the fire detecting terminals (10B) as well as the fire information message upon receiving the fire condition from the fire sensor. Thus, the master station can share the function of the fire detecting terminals to improve system versatility.

Most preferably, each of the master station and the fire detecting terminals is configured to include a master/slave selector which selects one of functions respectively given to the master station and the fire detecting terminal. Thus, the master station and the fire detecting terminals can be made into an identical structure for simplifying a system requirement as well as for enabling to alter the status of the master station to the fire detecting terminal and vice versa after installation of the system in premises.

Alternatively, the fire alarm system may be configured that the fire detecting terminals not detecting the fire occurrence are caused to switch into the constant reception mode from the intermittent reception mode only in response to the wake-up message from the master station. In this case, the fire detecting terminal is configured to transmit the fire detection message only to the master station, and the master station is responsive to the fire detection message for generating and transmitting the wake-up message to each of the fire detecting terminals so as to make all the fire detecting terminals ready for the multiple synchronous communication between the master station and the fire detecting terminals.

These and still other advantageous features of the present invention will become apparent from the following description of the preferred embodiment when taken in conjunction with the attached drawings.

BEST MODE FOR CARRYING OUT THE INVENTION

Figure 1:
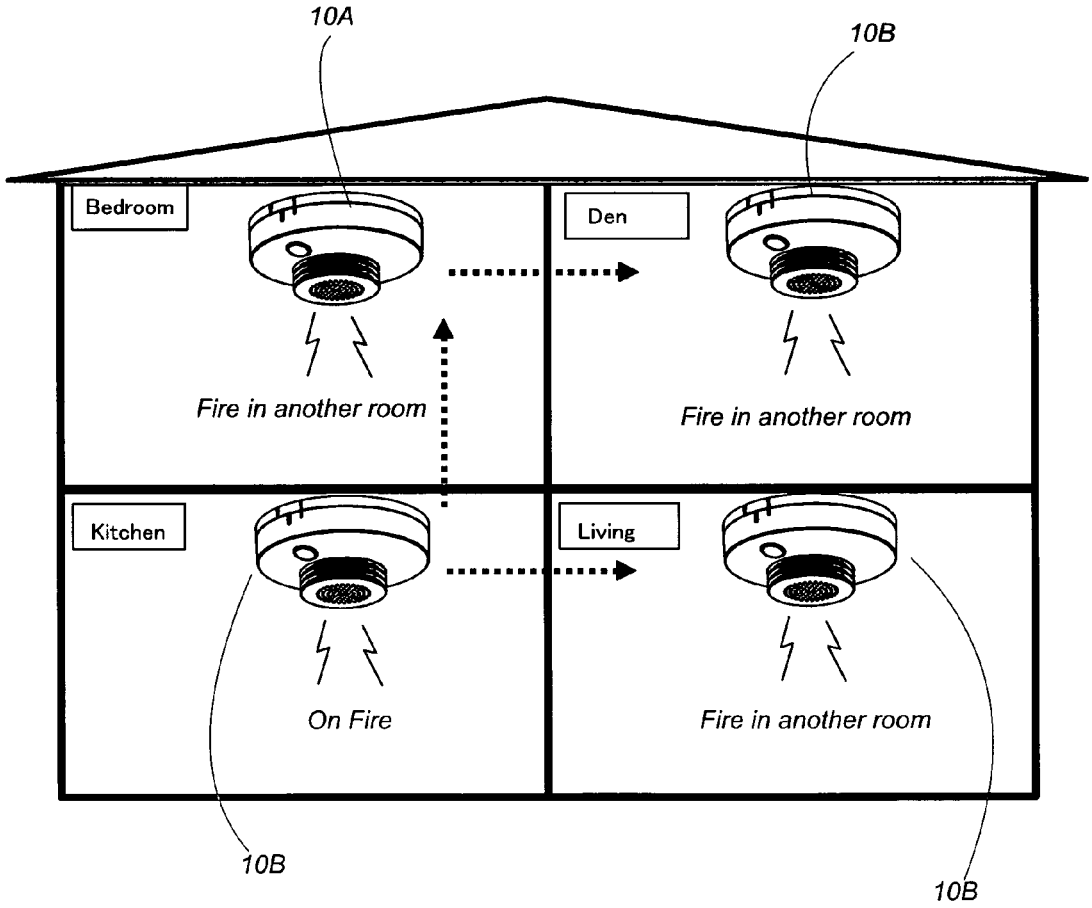
FIG. 1 is a schematic view illustrating an application of a wireless fire alarm system in accordance with a preferred embodiment of the present invention.

Referring now to FIG. 1, there is shown one typical application of a wireless fire alarm system in accordance with a preferred embodiment of the present invention. In brief, the fire alarm system includes a master station 10A installed in one particular room in premises, and a plurality of fire detecting terminals 10B installed respectively in other rooms. The fire detection terminal 10B is configured to detect a fire occurrence and transmit a fire detecting message upon detection of the fire occurrence to the other fire detecting terminals 10B and the master station 10A in order to give a fire alarm at each of the fire detecting terminals 10B and the master station 10A. The fire detecting message is generated at the fire detecting terminal and is transmitted by way of a radio communication. As will be discussed later, the master station 10A and the fire detecting terminal 10B are realized by one common module, and are designated to give respective functions as the master station and the fire detecting terminal by a master/slave selector.

Figure 2:
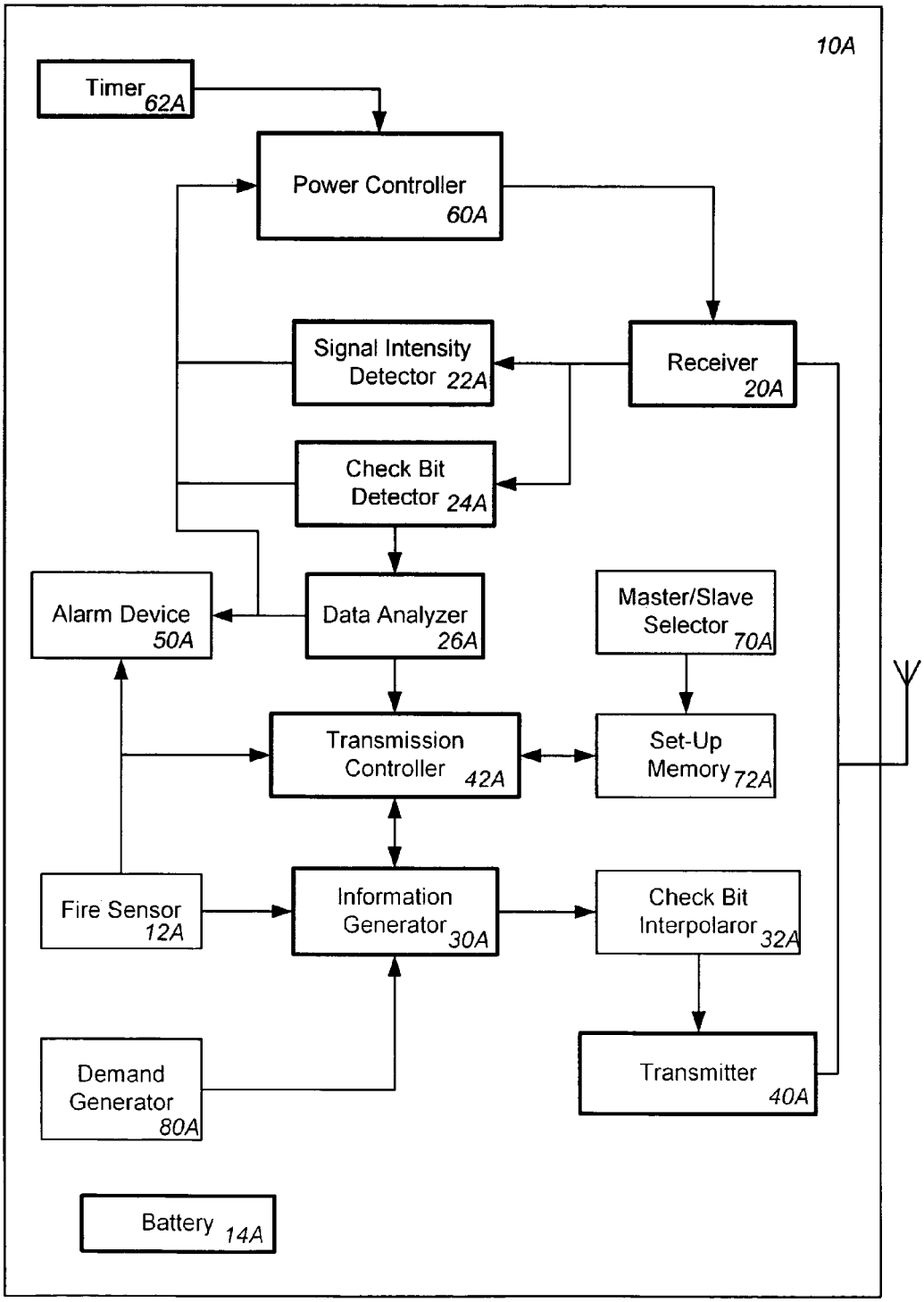
FIG. 2 is a block diagram of a master station utilized in the above system.
Figure 3:
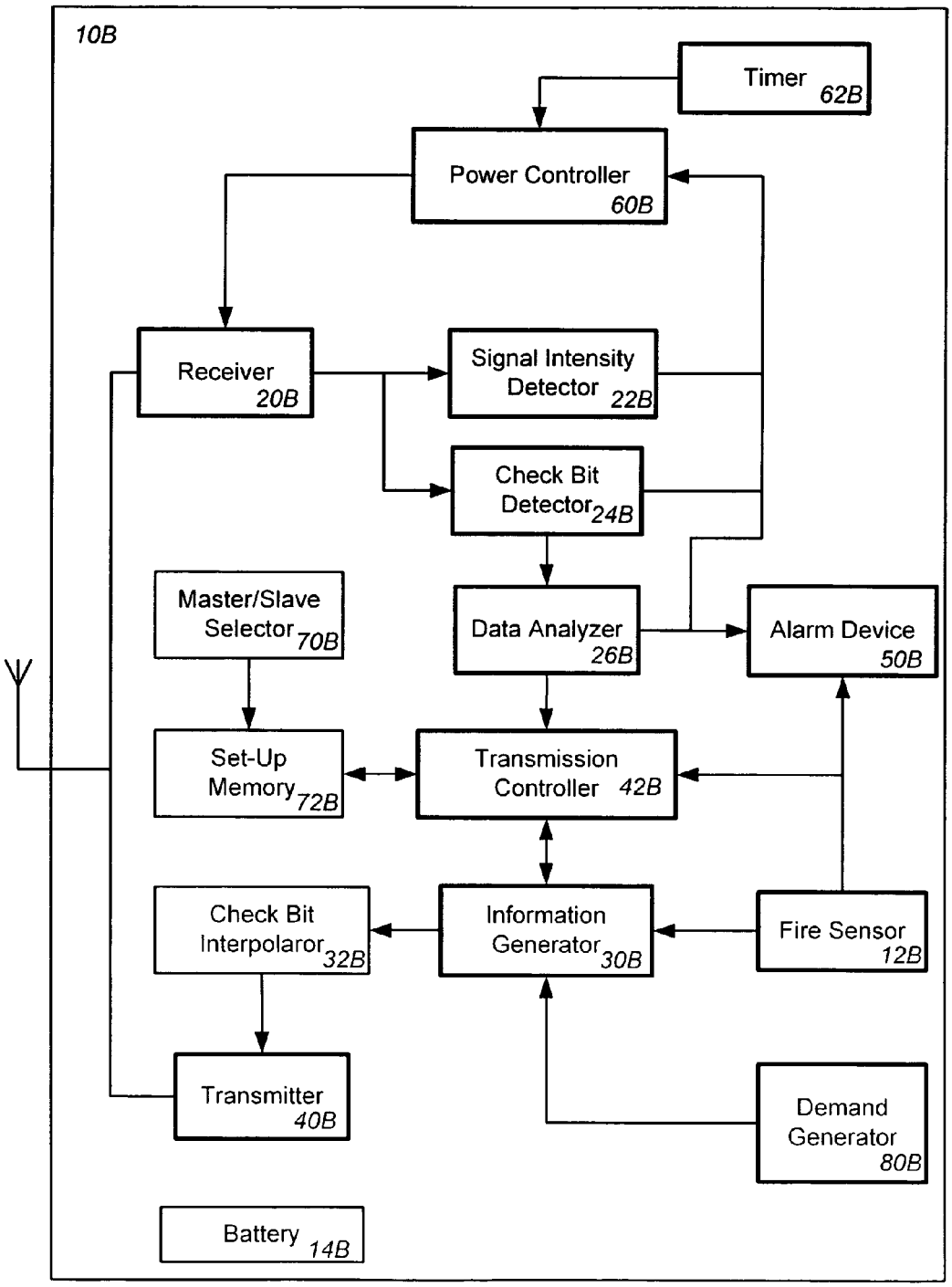
FIG. 3 is a block diagram of a fire detecting terminal utilized in combination with the master station in the above system.

FIGS. 2 and 3 show functional components of the master station 10A and the fire detecting terminals 10B. Prior to discussing the details of the system, it is noted that components belonging to the master station 10A are mentioned in the claims and the disclosure of the invention to be preceded by a modifier term of "first", while components belonging to the fire detecting terminal 10B are mentioned to be preceded by a modifier term of "second", while such modifier terms are omitted from the drawings and the following description only for the sake of simplicity.

As shown in FIG. 2, the master station 10A is powered by an incorporated battery 14A, and includes a receiver 20A for receiving the fire detection message, an information provider 30A for generating a wake-up message as well as fire information message after receiving the fire detection message from any one of the fire detecting terminals 10B, and a transmitter 40A for transmitting the wake-up message and fire information message to each of the fire detecting terminals. The fire information message is configured to define a time reference with regard to a series of timeslots each assigned to receive a reply message from each of the fire detecting terminals and to start a multiple synchronous communication with each of the fire detecting terminals by way of the timeslots. The time reference is given by a starting point of a unique word included in the fire information message from the master station 10A so that each of the fire detecting terminals 10B calculates its own timeslot based upon the time reference. The fire information message may optionally include a statement describing a number of the timeslots and identification of the timeslots. The multiple synchronous communication is realized by a time division multiple access (TDMA) scheme already known in the art. The master station 10A further includes an alarm device 50A which issue the fire alarm in the form of a voice when receiving the fire detection message from any one of the fire detecting terminals 10B. Further, the master station 10A is itself provided with a fire sensor 12A which detects the fire occurrence and activates the alarm device 50A to issue the fire alarm upon detection of the fire occurrence.

As shown in FIG. 3, the fire detecting terminal 10B is powered by an incorporated battery 14B and includes a fire sensor 12B for detection of the fire occurrence, an information generator 30B for generating the fire detection message upon detection of the fire occurrence, a transmitter 40B for transmitting the fire detection message, a receiver 70B for receiving the fire detection message from any one of the other fire detecting terminals as well as the wake-up message and the fire information message from the master station 10A, and an alarm device 50B configured to issue the fire alarm in the form of a voice upon receiving the fire detection message and the wake-up message or even the fire information message indicating the fire occurrence.

Figure 4:
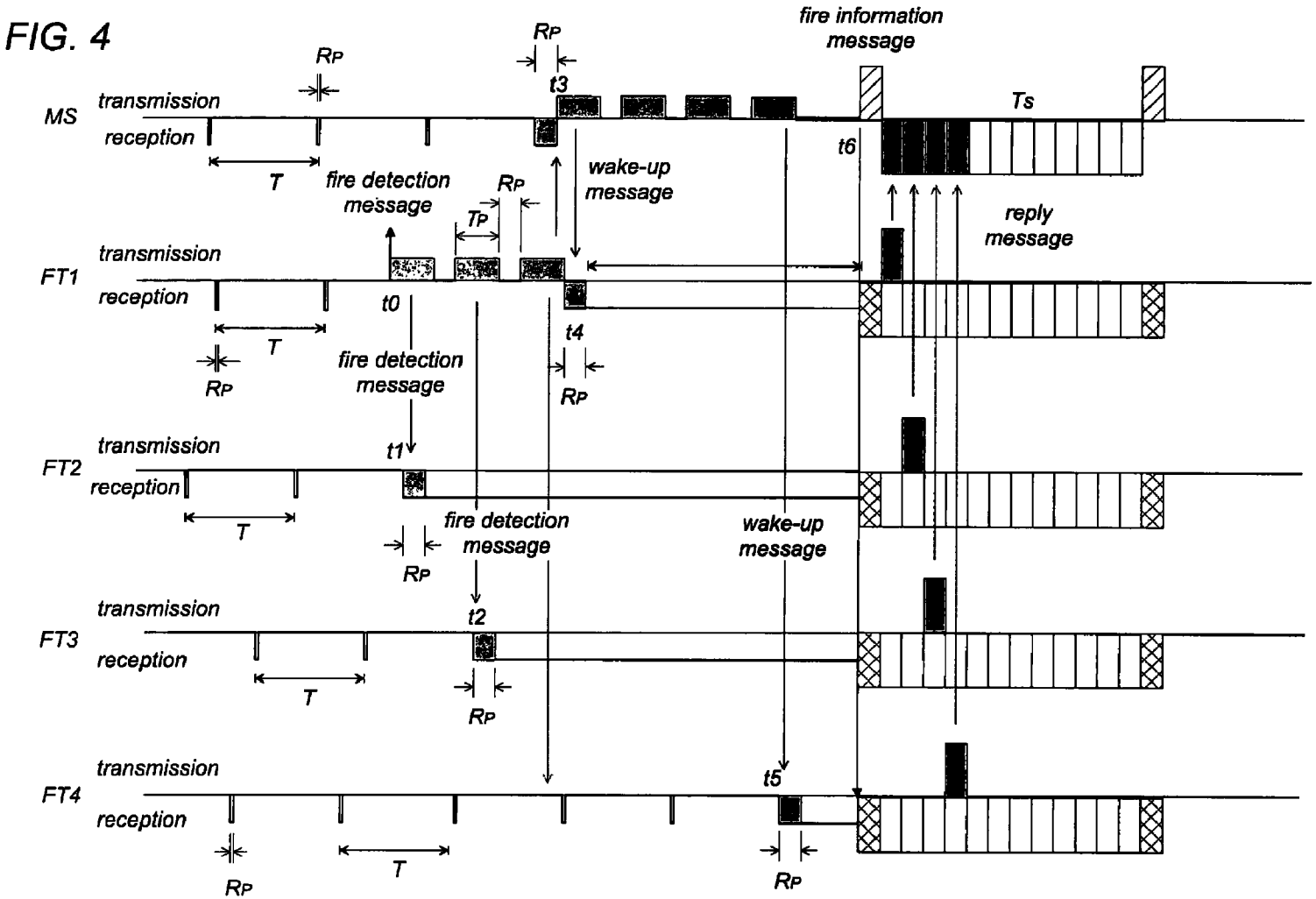
FIG. 4 is a time chart illustrating a fire detecting operation of the above system.

Also included in the fire detecting terminal 10B is a power controller 60B which is configured to selectively provide an intermittent reception mode of activating the receiver 20B in a limited reception period Rp alternating with a rest period, and a constant reception mode of constantly keeping the receiver 20B ready for receiving the data or message, as shown in FIG. 4. The power controller 60B is configured to select the intermittent reception mode until receiving the fire detection message or the wake-up message whichever comes earlier, and select the constant reception mode thereafter to receive the fire information message which establishes the multiple synchronous TDMA communication with the master station 10B. For the purpose of reducing the battery consumption during the TDMA communication, the power controller 60B of each fire detecting terminals 10B may be configured to allow the receiver 20B to activate only during a period corresponding to the timeslot of receiving the fire information message from the master station 10A, and to deactivate the receiver 20B for the rest of the TDMA communication.

In order to determine the contents of the messages, the fire detecting terminal 10B includes a data analyzer 26B which generates a trigger signal to the power controller 60B to select the constant reception mode when the received message is either the fire detection message from any one of the other fire detecting terminals or the wake-up message from the master station 10A. The power controller 60 sets the reception period Rp of several tens of milliseconds within which a receiving signal strength indication (RSSI) of the received data is checked, as will be discussed later. The reception period Rp is repeated at predetermined time intervals (T) of 5 to 10 seconds, for example, in accordance with a timing signal given from a timer 62B.

In addition to the components as described in the above, each of the master station 10A and the fire detecting terminal 10B, i.e., the common module is equipped with the master/slave selector 70A (70B) for selectively designating the common module as the master station 10A and the fire detecting terminal 10B, and also with a set-up memory 72A (72B) configured to store addresses of associated terminals in addition to the designated role for a multicast communication within the system. Further, the common module includes a transmission controller 42A (42B) which fetches the addresses from the set-up memory 72A (72B) each time the fire detecting terminal or the master station transmits the data to include the destined addresses in the transmitting message prepared at the information generator 30A (30B). Further, the common module includes a demand generator 80A (80B) which is configured to generate a stop demand in response to a user's entry by use an interface such as a button or keypad. The demand from the fire detecting terminal 10B is included in the reply message generated at the information generator 30B and is transmitted through the multiple synchronous communication to the master station 10A. In response to the stop demand, the master station 10A generates a stop instruction and transmits the fire information message including the stop instruction in order to stop issuing the fire alarm from the fire detecting terminals for a predetermined stop period.

Now, operation of the system is explained with reference to FIG. 4, where the fire alarm system is exemplarily shown to have the four fire detecting terminals 10B and the master station 10A respectively labeled with FT1 to FT4, and MS for easy understating of the operation. Each of the fire detecting terminals FT1 to FT4 and the master station MS are normally kept respectively in the intermittent reception mode where the individual power controllers 60B (60A) activate the corresponding receivers 20B (20A) in the limited reception period (Rp) alternating with the rest period, i.e., activate the receivers at regular intervals (T) of about 3 to 10 seconds. When any one of the fire detecting terminals 10B first detects the fire condition, for example, the fire detecting terminal of FT1 detects the fire condition at a time t0, the terminal FT1 responds to generate the fire detection message, concurrently with issuing the fire alarm from its own alarm device 50B. The fire detection message is destined to all the other fire detecting terminals FT2, FT3, FT4 and the master station MS, and is transmitted repeatedly in transmission period (Tp) alternating with reception period Rp. The fire detection message is successfully received at the other fire detecting terminals FT2, FT3 and the master station MS each having one of its intermittent reception periods (Rp) coincident with any one of the transmission periods (Tp). In the illustrated instance, the fire detecting terminals FT2 and FT3 receive the fire detection message respectively at times t1 and t2, and the master station MS receive the message at time t3. On the other hand, the terminal FT4 fails to receive the message when it spaced from the transmitting terminal FT1 by a distance greater than a maximum communication distance, or when the terminal FT4 receives a coincidental noise interfering with the message from terminal FT1, or even when any one of its reception periods Rp of the terminal FT4 is not coincident with any of the transmission periods Tp of the terminal FT1.

Upon receiving the fire detection message, the terminals FT2 and FT3 respond to issue the fire alarm from their own alarm device 50B, and are respectively switched into the constant reception mode to be ready for the multiple TDMA communication with the master station MS to receive and transmit the fire information message and the reply message. The master station MS, when receiving the fire detection message at time t3, is switched into a waking-up mode of generating and transmitting the wake-up message to all the terminals FT1 to FT4. The wake-up message is intended to wake-up any remaining terminal FT4 which has not yet been switched into the constant reception mode by the fire detection message from the terminal FT1, and is repeated for a limited number of times to successfully switch the terminal FT4 into the constant reception mode at time t5 and to cause the terminal FT4 to issue the fire alarm. It should be noted in this connection that even when each of the fire detecting terminals FT1 to FT4 is located within the maximum communication distance for successful radio communication with the master station MS, there may be a situation that one of the fire detecting terminals FT1 to FT4 is located far beyond the maximum communication distance from one or more particular fire detecting terminals. For example, when the terminal FT4 is spaced further away from the detecting terminal FT1 issuing the fire detection message than from the master station MS, the terminal FT4 fails to receive the fire detection message. However, as the terminal FT4 is within the maximum communication distance from the master station MS, the terminal FT4 can successfully receive the wake-up message from the master station MS and be therefore switched into the constant reception mode. Further, if the terminal FT4 should fail to be woke up by the fire detecting message from the terminal FT1 due to the interference with the noise or misregistration between the reception period Rp of FT4 and the transmission period Tp of FT1, the terminal FT4 can be successfully woke up by the wake-up message repeatedly transmitted from the master station MS.

Upon receiving the wake-up message at time t4, the terminal FT1 is caused to stop transmitting the fire detection message and come into the constant reception mode to be ready for the multiple TDMA communication with the master station MS. After transmitting the wake-up message for the predetermined number of times, the master station MS comes also into the constant reception mode to be ready for the multiple TDMA communication with all the terminals FT1 to FT4.

Subsequently at time t6, the master station MS generates and transmits the fire information message which includes a request for acknowledgment or the reply message from each of the terminals FT1 to FT4 through the individual timeslots. During this communication, the terminals FT1 to FT4 are held in constant communication with the master station for exchanging information and instructions for implementation of the fire alarm system.

When any one of the fire detecting terminals 10B transmits the reply message including the stop demand of requesting the stop of the fire alarm, the master station 10A responds to generate the stop instruction at the information generator 30A. The stop instruction is included in the subsequent fire information message transmitted from the master station 10A to all the fire detecting terminals 10B which responds to stop issuing the fire alarm from the individual alarm device 50B for the limited stop period, for example, 3 minutes to 6 minutes. When receiving information indicative of the fire occurrence within this stop period, the alarm device 50B is caused to resume issuing the fire alarm. Such information includes the detection of the fire occurrence by the fire sensor or the reception of the fire information message including the fire occurrence.

In this connection, the fire detecting terminal 10B generates a restoration request at the information generator 30B when the fire sensor 12B detects no fire occurrence. The restoration request is included in the reply message to be transmitted to the master station 10A of which information generator 30A responds to generate a restoration instruction and include the restoration instruction in the subsequent fire information message. Upon receiving such fire information at the fire detecting terminals 10B, the power controller 60B of each terminal resets to the intermittent reception mode, while at the same time the master station 10A is reset to its intermittent reception mode for saving the battery power at either of the fire detecting terminals 10B and the master station 10A.

In addition to the above power saving arrangement, the fire alarm system includes a further power saving scheme of terminating the instant reception period (Rp) of the fire detecting terminal 10B as well as the master station 10B immediately upon finding that receiving data is a noise for minimizing the battery consumption. That is, when the receiving data is other than the valid data, i.e., the fire detection message or the wake-up message, the power controller 60A (60B) responds to terminate current reception period (Rp) which would otherwise last for the predetermined period to continue receiving and attempt to interpret the noise.

Figure 5:
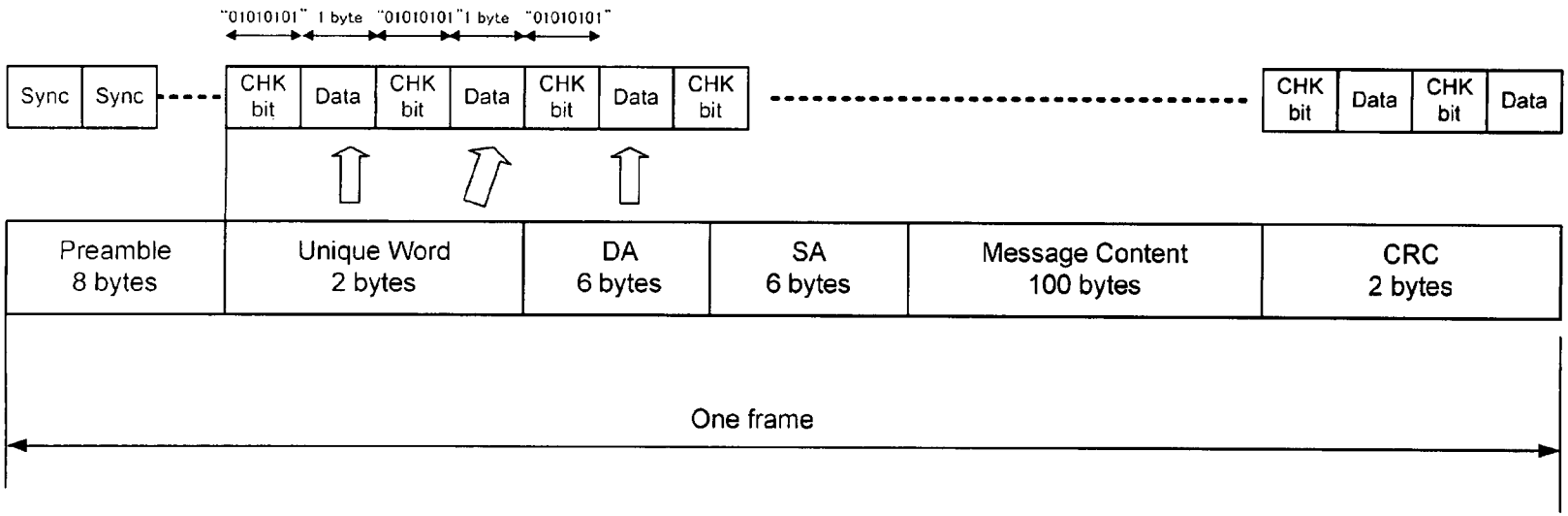
FIG. 5 is a schematic view of a data structure of a message transmitted among the master station and the fire detecting terminal.

In order to discriminate the valid message from possible noises, the valid message generated at the information generator 30A (30B) is configured to have a data structure as shown in FIG. 5. The data is basically structured to have a unique word of 2 bytes following a preamble containing a synchronous bit series of 8 bytes, a destination address of 6 bytes, a source address of 6 bytes, a message content of 100 bytes, and a CRC (cyclic redundancy check) of 2 bytes. For distinguishing the message from the noises, a check bit pattern of "01010101" is inserted at a predetermined cycle, i.e., one byte length cycle, into the message so as to give a bit interpolated message in which the check bit pattern starts from the beginning of the data frame, i.e., the unique word and ending at the CRC, and alternate with one byte fraction of the data. When the check bit pattern fails to appear in the receiving data, the system determines that the receiving data is simply the noise and operates to immediately terminate the current reception period (Rp) and to provide a next reception period after the elapse of the rest period.

For this purpose, the common module 10A (10B) includes a check bit interpolator 32A (32B) configured to insert the check bit pattern of "01010101" into one frame of the message to give the bit interpolated message of FIG. 5, and a check bit detector 24A (24B) configured to detect whether the check bit pattern appears at the predetermined cycle in the received data, in addition to a signal intensity detector 22A (22B) configured to provide the receiving signal strength indication (RSSI) of the received data.

As is explained hereinbefore, the power controller 60A (60B) is configured to intermittently activate the corresponding receiver 20A (20B) only for the reception period (Rp) of several tens of milliseconds, which repeat at predetermined intervals of about 5 to 10 seconds given by a timing signal from the corresponding timer 62A (62B) with the reception period alternating with the rest period. Thus, the receiver is kept in an idling mode only in the reception period with a minimum consumption of the battery power so as to be ready for receiving signal or data, while it is kept halted for the rest period without consuming the battery power. When receiving the signal or data in each of the reception period, the receiver becomes activated to start checking reading the signal or data at an expense of a certain battery consumption.

Figure 6:
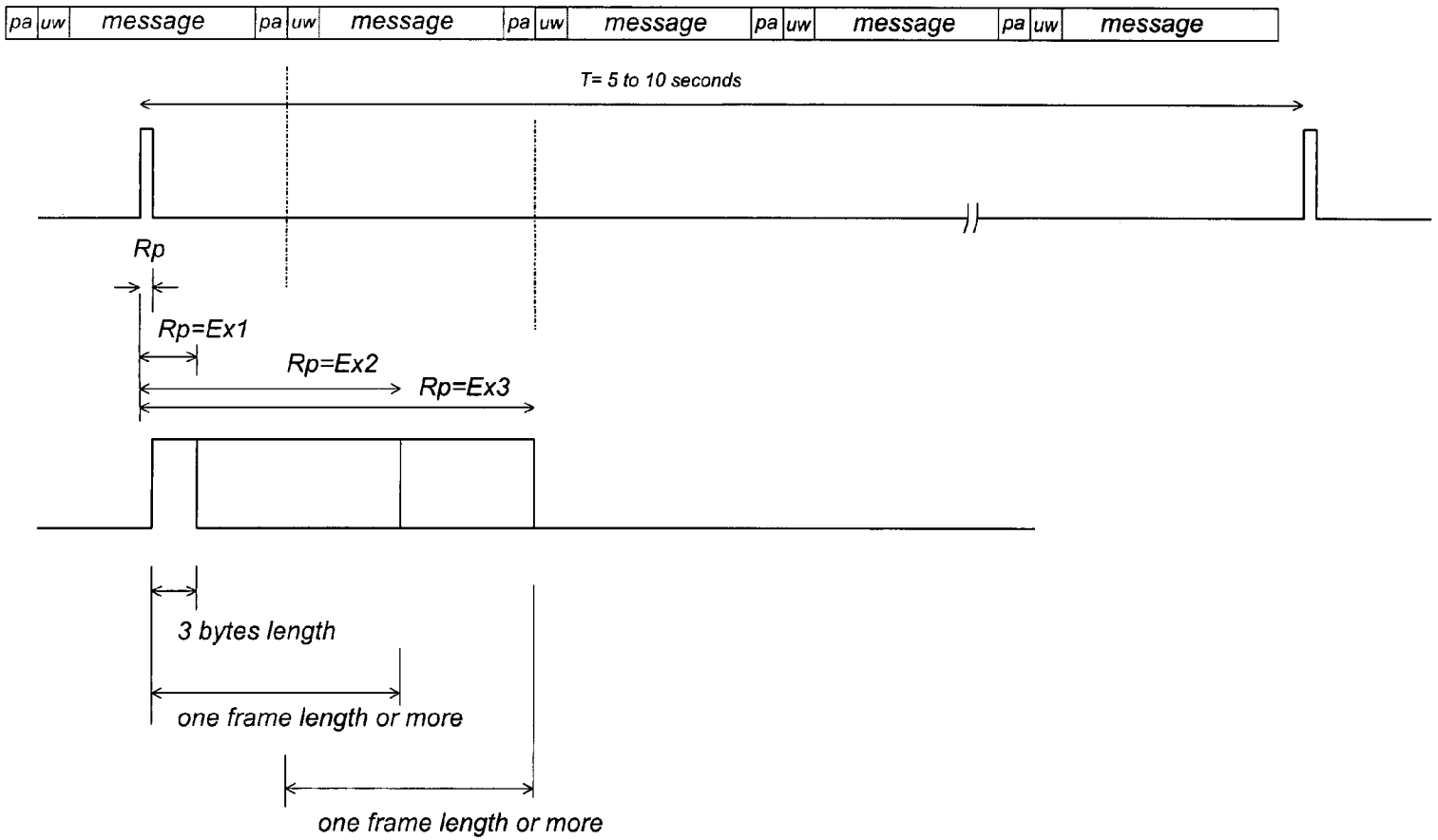
FIG. 6 is a time chart illustrating a data processing operation of the above system.

As shown in FIG. 6, the system is configured to transmit a series of the fire detection messages or the fire wake-up messages until the constant reception mode is available. The fire detection message or the wake-up message is transmitted as a time series successive data. On the receiving side, it is first checked at each of the reception period Rp whether or not the RSSI of the received signal is greater than the threshold. When RSSI is found at the signal intensity detector 22A (22B) to be greater than the threshold within the reception period Rp, the power controller 60A (60B) responds to extend the reception period Rp up to a first extended reception period which lasts for a 3 bytes lengths (Rp=Ex1) for checking whether or not the incoming signal or message includes at least one check bit pattern "01010101". If the check bit detector 24A (24B) fails to acknowledge the check bit pattern, the power controller 60A (60B) responds to immediately terminate the first extended reception period (Ex1) to deactivate the receiver 20A (20B) and the associated components until the next reception period (Rp). When the check bit pattern is acknowledged within the first extended period (Rp=Ex1), the power controller 60A (60B) extends the reception period up to a length equal to one frame length of the message or more (Rp=Ex2) to see whether or not the unique word is included in the received message. When no unique word is found within the second extended period (Ex2), i.e., the receiving message is other than that specifically designed to the present system, the power controller 60A (60B) responds to immediately terminate the second extended reception period (Ex2) to deactivate the receiver 20A (20B) and the associated components until the next reception period (Rp). Otherwise, or when the unique word is found within the second extended period, the power controller 60A (60B) authenticates the message and extends the reception period to a third extended reception period (Rp=Ex3) which ends at a point spaced by the one frame length or more from the start of the unique word founded, in order to complete reading the message. It is noted that if the check bit pattern should fail to appear within each two bytes length during the extended reception period Ex2 or Ex3, the power controller 60A (60B) regards the receiving message is the noise or the data not intended to the present system and terminates the extended reception period.

Figure 7:
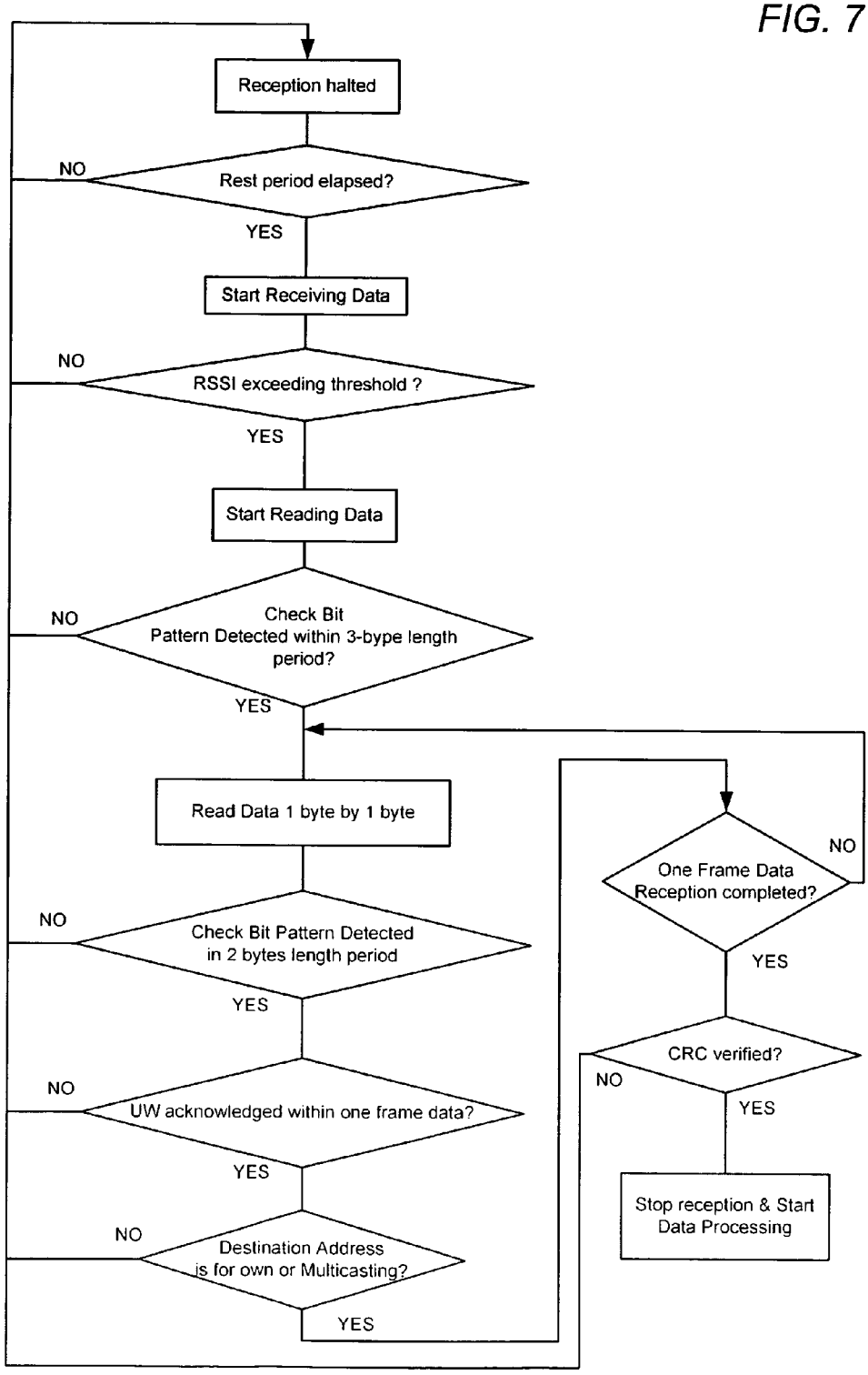
FIG. 7 is a flow chart illustrating the data processing operation of the above system.

Details of the above noise or non-system message rejecting operation are illustrated in the flow chart of FIG. 7. First, when the reception halting rest period is over, the power controller 60A (60B) activates the receiver 20A (20B) to be ready for receiving the data. A step follows to determine whether RSSI of the receiving signal exceeds a predetermined threshold at the signal intensity detector 22A (22B). When RSSI is found greater than the threshold, the reception period Rp is extended to the first extended reception period (Ex1) of about a few tens of milliseconds to start receiving the message. Then, the check bit detector 24A (24B) checks whether the check bit pattern "01010101" appears once or twice within the first extend period (Ex1) corresponding to 3 bytes length. If the check bit pattern fails to appear, the power controller 60A (60B) provides a stop signal for terminating the reception period and therefore the current receiving operation to save the battery power. When the check bit pattern is acknowledged, the power controller 60A (60B) further extends the reception period to a second extended reception period (Rp=Ex2) corresponding to one frame length or more so that the data analyzer 26A (26B) can read the preamble and determine whether the unique word is found within the second extended reception period. If the unique word is not found, the power controller 60A (60B) responds to provide the stop signal for terminating the second extended period (Ex2) and deactivating the receiver 20A (20B) and the associated components to save the battery power. When the unique word is found, the reception period is further extended to the third extended reception period (Ex3) to complete reading the one frame message within a detection period of one frame length or more starting from the unique word. If the check bit pattern fails to appear at the predetermined cycle, i.e., 2 bytes length cycle during the second or third extended period, the power controller acknowledges that the receiving data is invalid and provides the stop signal for immediately terminating the current receiving operation to save the battery power as well.

In this manner, the receiving data is continuously checked. If the check bit detector 24A (24B) detects no further data within the third extended reception period, the power controller provides the stop signal for terminating the instant receiving operation until next activation of the receiver. When, on the other hand, the data continues within the third extended period (Ex3), the data analyzer 26A (26B) checks whether the destination address in the receiving data designates the own address of the transmitting terminal (station) or those of the other terminals (station). If the address is determined for its own or for multicasting to the other receiving terminals (master station), the sequence goes to a step of checking whether one frame data reception is completed, and to check whether the CRC is verified. If one frame data reception is not completed, the data analyzer 26A (26B) requests the power controller 60A (60B) to continue activate the receiver 20A (20B) to read the remaining data 1 byte by 1 byte. If the CRC fails, the data analyzer 26A (26B) issues another stop signal to the power controller for immediately terminating the instant receiving operation. If the CRC is verified, the data analyzer 26A (26B) acknowledges the completion of the valid receiving data, stops the receiving operation, and starts a data processing for causing the information provider 50A (50B) to issue the information as instructed by the receiving data.

It should be noted here that the data is prepared by a non return-to-zero coding so that check bit detector 24A (24B) can be shared to make the function of achieving the bit synchronization for receiving the data in response to the preamble, and to make the function of detecting the check bit pattern.

Although the above embodiment describes that the check bit pattern is inserted in the data stream beginning from the unique word, the system of the present invention may have a configuration in which the check bit pattern is inserted in the data stream after the unique word in order to make the unique word sufficiently distinctive with a simple coding design.

Figure 8:
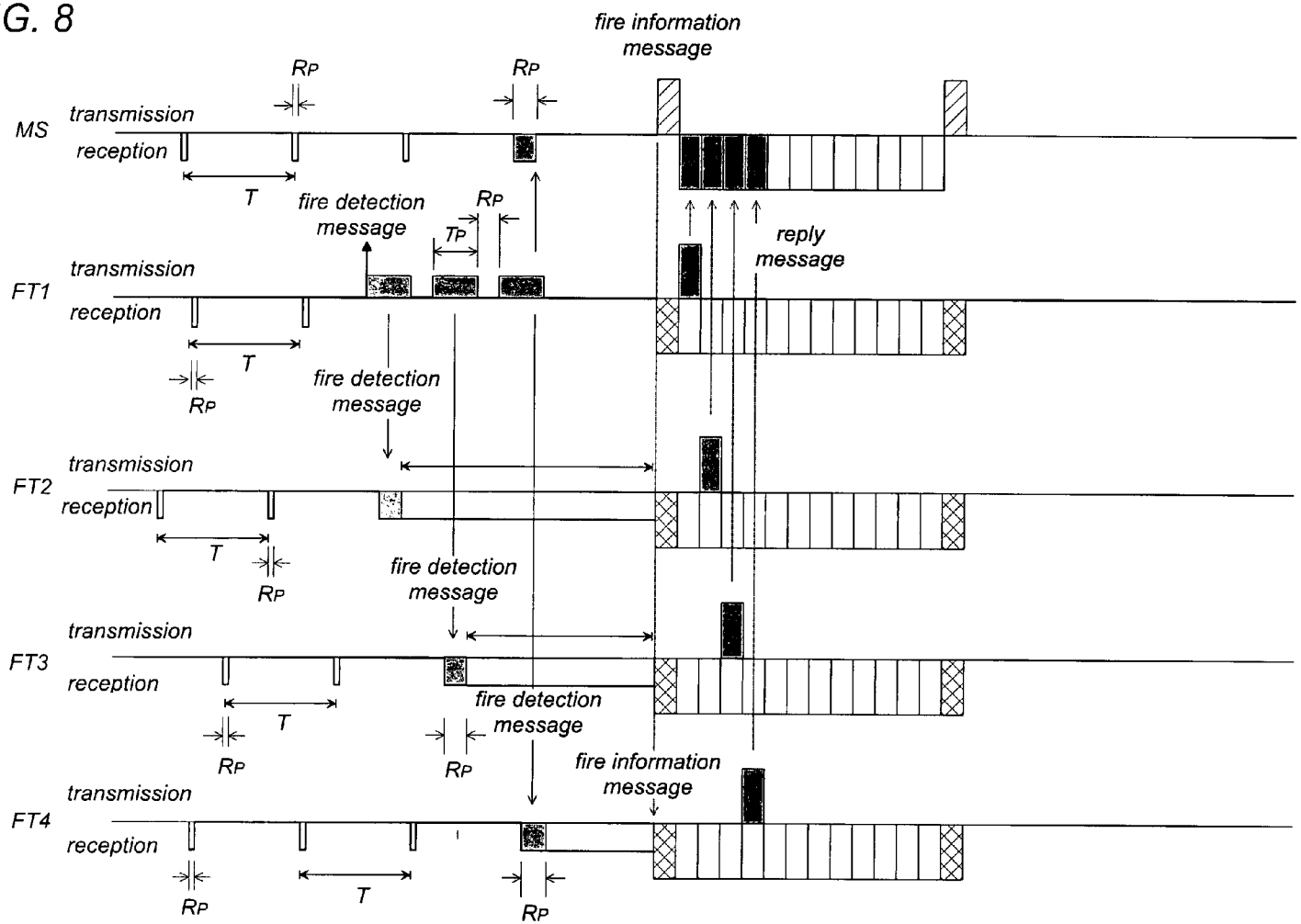
FIG. 8 is a time chart illustrating a fire detecting operation in accordance with a modification of the above embodiment.

FIG. 8 shows a modification of the above system which is identical to the above embodiment except that the master station 10A (MS) is dispensed with the function of generating the wake-up message. Instead, the fire detecting terminal FT1 of which fire sensor detects the fire occurrence is configured to transmit the fire detection message for a limited number of times sufficient to wake-up the other fire detecting terminals and the master station. The number of times is determined depending upon the number of the fire detecting terminals, the reception period (Rp) and the intervals (T) at which the reception period (Rp) repeats.

Figure 9:
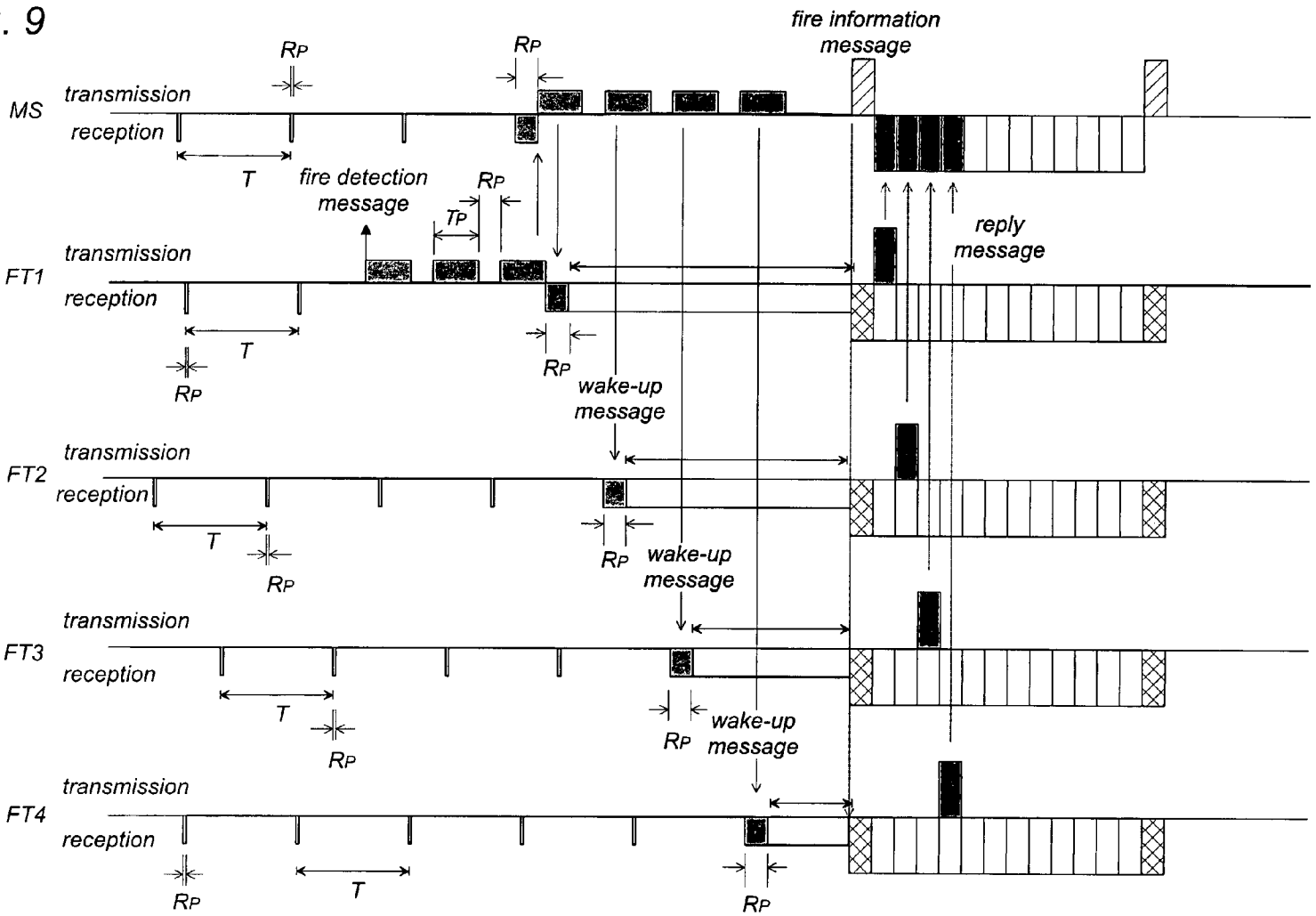
FIG. 9 is a time chart illustrating a fire detecting operation in accordance with a second embodiment of the present invention.

FIG. 9 shows another fire detection system in accordance with a second embodiment of the present invention which is basically identical to the above embodiment except that each of the fire detecting terminals 10B (FT1 to FT4) is configured to transmit the fire detection message only to the master station 10A (MS) upon detection of the fire occurrence at its own fire sensor. In this connection, the fire detecting terminal 10B is switched from the intermittent reception mode to the constant reception mode upon receiving the wake-up message from the master station 10A (MS). For this purpose, the master station is configured to transmit the wake-up message repeatedly by a predetermined number of times for successfully waking up all the fire detecting terminals. The number of times or period is selected depending upon the number of the fire detecting terminals, the reception period (Rp) and the intervals (T) at which the reception period (Rp) repeats. The fire detecting terminal FT1 detecting the fire occurrence is cause to stop transmitting the fire detection message upon reception of the wake-up message from the master station (MS) and is then switched into the constant reception mode to be ready for multiple synchronous communication with the master station (MS). The other functions are identical to the previous embodiment and no duplicate description is deemed necessary. However, it should be noted here that the fire alarm system is based upon an inventive concept that the fire detection terminal is switched from the intermittent reception mode to the constant reception mode in response to the reception of information indicative of the fire occurrence transmitted as the fire detection message from the other fire detecting terminal or transmitted as the wake-up message from the master station.

Further, the master station can be configured to provide a function of providing the fire detection message to itself and transmitting the fire detection message to the fire detection terminals upon detection of the fire occurrence by its own fire sensor. In this instance, the master station responds to generate the wake-up message and the fire information message in response to the fire detection message generated in the master station itself, thereby achieving the same function in much the same way as receiving the fire detection message from the fire detecting terminal.

Although the present invention is explained hereinabove basically with reference to the illustrated embodiments, the present invention is not limited to the specific embodiments and may include a combination of the individual features as disclosed in the above.

The invention claimed is:

1. A wireless fire alarm system comprising a master station and a plurality of battery-powered fire detecting terminals which are linked for wireless communication with each other, said master station comprising:

a first receiver configured to receive a fire detection message from any one of said fire detecting terminals;

a first information generator configured to generate a fire information message after receiving said fire detection message from any one of said fire detecting terminals, said fire information message being configured to define a time reference with regard to a series of timeslots each assigned to receive a reply message from each of said fire detecting terminals and to start a multiple synchronous communication with each of said fire detecting terminals by way of said timeslots;

a first transmitter configured to transmit said fire information message to each of said fire detecting terminals;

each of said fire detecting terminals comprising:

a second battery energizing said fire detecting terminal;

a fire sensor configured to detect a fire condition;

a second information generator configured to generate said fire detection message upon detection of said fire condition;

a second transmitter configured to transmit said fire detection message;

a second receiver configured to receive said fire detection message and said fire information message;

an alarm device configured to issue a fire alarm upon receiving said fire detection message or said fire information message;

wherein each of said fire detecting terminals includes a second power controller which is configured to selectively provide an intermittent reception mode of activating said second receiver in a limited reception period alternating with a rest period, and a constant reception mode of constantly keeping said second receiver ready for receiving said fire information message, said second power controller is configured to select the intermittent reception mode until receiving said fire detection message, and select said constant reception mode thereafter to receive said fire information message for establishing said multiple synchronous communication by way of said timeslots, said master station is powered by an incorporated battery, and includes a first power controller configured to selectively provide an intermittent reception mode of activating the first receiver in a limited reception mode alternating with a rest period, and a constant reception mode of constantly keeping said first receiver ready for receiving the fire information message, said first power controller is configured to select the intermittent reception mode until receiving said fire detection message from anyone of said fire detecting terminals, and select said constant reception mode thereafter to transmit said fire information message for starting said multiple synchronous communication with said fire detection terminals.

2. A wireless fire alarm system as set forth in claim 1, wherein said first information generator of the master station is configured to generate a wake-up message after receiving said fire detection message from any one of said fire detecting terminals, said wake-up message being configured to be destined for all the fire detecting terminals, said first transmitter of said master station is configured to transmit said wake-up message over a predetermined period before transmitting said fire information message in order to wake-up said fire detecting terminals, said second power controller of each said fire detecting terminal being configured to select said constant reception mode upon receiving said wake-up message or said fire detection message whichever comes earlier so as to be ready for multiple synchronous communication with said master station commenced by said fire information message.

3. A wireless fire alarm system as set forth in claim 2, wherein said second transmitter of the fire detecting terminal is configured to continue transmitting said fire detection message until receiving said wake-up message from said master station.

4. A wireless fire alarm system as set forth in claim 3, wherein each fire detecting terminal is configured to issue said fire alarm from said alarm device upon receiving said wake-up message or said fire detection message whichever comes earlier.

5. A wireless fire alarm system as set forth in claim 2, wherein said first power controller is configured to select the intermittent reception mode until receiving said fire detection message from anyone of said fire detecting terminals, and thereafter select a waking-up mode of transmitting said wake-up message repeatedly for a limited number of times followed by said constant reception mode of transmitting said fire information message for staring said starting said multiple synchronous communication with said fire detection terminals.

6. A wireless fire alarm system as set forth in claim 5, wherein said master station includes an alarm device configured to issue a fire alarm upon receiving said fire detection message.

7. A wireless fire alarm system as set forth in claim 6, wherein said master station include a first fire sensor configured to detect a fire condition, said information generator of said master station being configured to generate said fire detection message upon receiving said fire condition from said first fire sensor of said master station;

said first transmitter of said master station being configured to transmit said fire detection message;

each of said master station and said fire detecting terminals is configured to include a master/slave selector which selects one of functions respectively given to said master station and said fire detecting terminal.

8. A wireless fire alarm system as set forth in claim 5, wherein said master station includes a fire sensor configured to detect a fire condition, the first information generator of the master station is configured to generate said fire detection message to be transmitted to each of said fire detecting terminals as well as said fire information message upon receiving the fire condition from said fire sensor.

9. A wireless fire alarm system as set forth in claim 8, wherein said master station includes an alarm device configured to issue a fire alarm upon detection of said fire condition at said fire sensor of said master station or reception of said fire detection message from any one of said fire detecting terminals.

10. A wireless fire alarm system as set forth in claim 2, wherein said first transmitter of the master station being configured to transmit said fire information message to start said multiple synchronous communication with said fire detecting terminals with a delay of a predetermined period after receiving said fire detection message first from any one of said fire detecting terminals.

11. A wireless fire alarm system as set forth in claim 1, wherein said first transmitter of the master station being configured to transmit said fire information message to start said multiple synchronous communication with said fire detecting terminals with a delay of a predetermined period after receiving said fire detection message first from any one of said fire detecting terminals.

12. A wireless fire alarm system as set forth in claim 1, wherein each of said fire detecting terminals includes a demand generator which generates a stop demand to be transmitted to said master station by way of the multiple synchronous communication;

said information generator of the master station being configured to generate a stop instruction and include the stop instruction in said fire information message upon receiving said stop demand, said fire information message being transmitted to each of said fire detecting terminal by way of said multiple synchronous communication, each of said fire detecting terminals being configured to stop issuing said fire alarm from said alarm device for a predetermined stop period upon receiving the fire information message including said stop instruction from said master station.

13. A fire alarm system as set forth in claim 12, wherein each of said fire detecting terminals is configured to resume issuing said fire alarm when receiving information indicative of the fire occurrence during said stop period.

14. A wireless fire alarm system as set forth in claim 1, wherein each said fire detecting terminals is configured to generate and transmit a restoration request in the form of said reply message by way of said multiple synchronous communication when the fire condition is not detected at each of said fire sensors, said information generator of the master station being configured to generate a restoration instruction and include said restoration instruction in said fire information message when said master station receive said restoration request from all of said fire detecting terminals, said fire information message being transmitted to each of said fire detecting terminals, and said second power controller of each fire detecting terminal is configured to switch into said intermittent reception mode upon receiving the fire information message including said restoration instruction.

15. A wireless fire alarm system as set forth in claim 1, wherein said master station includes an alarm device configured to issue a fire alarm upon receiving said fire detection message.

16. A wireless fire alarm system as set forth in claim 15, wherein said master station include a first fire sensor configured to detect a fire condition, said information generator of said master station being configured to generate said fire detection message upon receiving said fire condition from said first fire sensor of said master station;

said first transmitter of said master station being configured to transmit said fire detection message;

each of said master station and said fire detecting terminals is configured to include a master/slave selector which selects one of functions respectively given to said master station and said fire detecting terminal.

17. A wireless fire alarm system as set forth in claim 1, wherein said master station includes a fire sensor configured to detect a fire condition, the first information generator of the master station is configured to generate said fire detection message to be transmitted to each of said fire detecting terminals as well as said fire information message upon receiving the fire condition from said fire sensor.

18. A wireless fire alarm system as set forth in claim 17, wherein said master station includes an alarm device configured to issue a fire alarm upon detection of said fire condition at said fire sensor of said master station or reception of said fire detection message from any one of said fire detecting terminals.

19. A wireless fire alarm system comprising a master station and a plurality of battery-powered fire detecting terminals which are linked for wireless communication with each other, said master station comprising:

a first receiver configured to receive a fire detection message from any one of said fire detecting terminals;

a first information generator configured to generate a wake-up message and a fire information message after receiving said fire detection message from any one of said fire detecting terminals, said wake-up message being configured to be destined for all of said fire detecting terminals, said fire information message being configured to include a statement defining (provide) a series of timeslots each assigned to receive a response from each of said fire detecting terminals and to start a multiple synchronous communication (time division multiple access) with each of said fire detecting terminals by way of said timeslots;

a first transmitter configured to transmit said wake-up message first for a predetermined period for a predetermined period in response to said fire detection message and subsequently transmit said fire information message to each of said fire detecting terminals;

each of said fire detecting terminals comprising:

a second battery energizing said fire detecting terminal;

a fire sensor configured to detect a fire condition;

a second information generator configured to generate said fire detection message upon occurrence of said fire condition;

a second transmitter configured to transmit said fire detection message;

a second receiver configured to receive said wake-up message and said fire information message;

an alarm device configured to issue a fire alarm upon receiving said fire detection message or said wake-up message;

wherein each of said fire detecting terminals includes a second power controller which is configured to selectively provide an intermittent reception mode of activating said second receiver in a limited reception period alternating with a rest period, and a constant reception mode of constantly keeping said second receiver ready for receiving said fire information message, said second power controller is configured to select the intermittent reception mode until receiving said wake-up message, and select said constant reception mode thereafter to receive said fire information message for establishing said multiple synchronous communication by way of said timeslots.

* * * * *